US010584877B2

(12) United States Patent
Spence et al.

(10) Patent No.: US 10,584,877 B2
(45) Date of Patent: Mar. 10, 2020

(54) DEVICE TO CORRECT FLOW NON-UNIFORMITY WITHIN A COMBUSTION SYSTEM

(71) Applicant: Doosan Heavy Industries & Construction Co., Ltd., Gyeongsangnam-do (KR)

(72) Inventors: Kevin Spence, Jupiter, FL (US); Vladimir Belyaev, Greer, SC (US)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 310 days.

(21) Appl. No.: 15/582,015

(22) Filed: Apr. 28, 2017

(65) Prior Publication Data

US 2018/0313541 A1 Nov. 1, 2018

(51) Int. Cl.

| | |
|---|---|
| ***F23R 3/14*** | (2006.01) |
| ***F23R 3/46*** | (2006.01) |
| ***F23R 3/28*** | (2006.01) |
| ***F23R 3/34*** | (2006.01) |
| ***F23R 3/12*** | (2006.01) |
| *F23D 23/00* | (2006.01) |

(52) U.S. Cl.

CPC ..... *F23R 3/14* (2013.01); *F23R 3/12* (2013.01); *F23R 3/286* (2013.01); *F23R 3/343* (2013.01); *F23R 3/346* (2013.01); *F23R 3/46* (2013.01); *F05D 2240/35* (2013.01); *F23D 23/00* (2013.01); *F23R 2900/00014* (2013.01)

(58) Field of Classification Search

CPC .... F23R 3/12; F23R 3/14; F23R 3/286; F23R 3/343; F23R 3/346; F23R 3/46

See application file for complete search history.

(56) References Cited

U.S. PATENT DOCUMENTS

| | | | | |
|---|---|---|---|---|
| 5,284,019 | A * | 2/1994 | Vdoviak | F23C 7/02 60/733 |
| 5,983,643 | A * | 11/1999 | Kiesow | F23R 3/34 431/175 |
| 2011/0296839 | A1* | 12/2011 | Van Nieuwenhuizen | F23R 3/286 60/737 |
| 2013/0104554 | A1* | 5/2013 | Bode | F23D 11/38 60/740 |
| 2014/0033718 | A1* | 2/2014 | Manoharan | F23R 3/10 60/725 |
| 2014/0311151 | A1* | 10/2014 | Saito | F23R 3/42 60/737 |

(Continued)

FOREIGN PATENT DOCUMENTS

| | | | |
|---|---|---|---|
| JP | 2012-083099 | A | 4/2012 |
| JP | 2014-215036 | A | 11/2014 |

*Primary Examiner* — Steven M Sutherland

(74) *Attorney, Agent, or Firm* — Invenstone Patent, LLC

(57) ABSTRACT

A combustor can include: a combustion chamber; a cap covering the combustion chamber; a first swirler inlet cup passing through the cap and having a first length and a first bell mouth; a second swirler inlet cup passing through the cap and having a second length and a second bell mouth; and a third swirler inlet cup passing through the cap and having a third length and a third bell mouth, wherein the first length is different from the third length, and wherein the first bell mouth is different from the third bell mouth. The first, second, and third swirler inlet cups can have different diameters, respectively.

12 Claims, 5 Drawing Sheets

(56) References Cited

U.S. PATENT DOCUMENTS

| | | | | |
|---|---|---|---|---|
| 2014/0318135 | A1* | 10/2014 | Knapp | F23R 3/14 60/737 |
| 2015/0211742 | A1* | 7/2015 | Lee | F23R 3/286 60/772 |
| 2016/0209040 | A1* | 7/2016 | Tamura | F23R 3/32 |

* cited by examiner

600

| | Current design | Mod. 15-R15mm |
|---|---|---|
| Air pocket |   | HSN No Air Pocket<br>LSN  |
| Flow uniformity | HSN = 0.855<br>LSN = 0.857 | HSN = 0.958<br>LSN = 0.954 |
| Axial component profile |  |  |

DEVICE TO CORRECT FLOW NON-UNIFORMITY WITHIN A COMBUSTION SYSTEM

BACKGROUND OF THE INVENTION

A gas turbine generally comprises a compressor, a combustor, and a turbine, wherein the compressor provides compressed air generated by a plurality of compressor blades to a combustion chamber of the combustor through a plurality of swirler inlet cups and a hot gas generated by the compressed air in the combustion chamber is provided to the turbine. Even though the plurality of swirler inlet cups are placed in the different positions of the combustor, the plurality of swirler inlet cups have the same length and the same bell mouth. As a result, when the compressed air flows through the plurality of swirler inlet cups, the air-flow is separated and air pockets are formed in the swirler inlet cups. That is, the air-flow is not uniform in the swirler inlet cups and thus flame-holding events occur in the combustion chamber.

BRIEF SUMMARY

The present invention relates to a combustor for a gas turbine, more particularly, to a combustion system inhibiting non-uniform air-flow in a swirler inlet cup. In many embodiments, a combustion system according to the subject invention comprises a plurality of swirler inlet cups having different lengths, and in some embodiments the inlet cups may have different bell mouths.

In an embodiment of the present invention, a combustion system can include a first swirler inlet cup having a first length, and a second swirler inlet cup having a second length, wherein the first length of the first swirler cup is different from the second length of the second swirler inlet cup.

In another embodiment of the present invention, a combustion system can include a peripheral swirler inlet cup having a peripheral bell mouth, and a center swirler inlet cup having a center bell mouth, wherein the peripheral bell mouth and the center bell mouth are different from each other, and wherein a length of the peripheral swirler inlet cup is different from a length of the center swirler inlet cup.

In yet another embodiment of the present invention, a combustor can include a combustion chamber, a cap covering the combustion chamber, a plurality of first swirler inlet cups passing through the cap and having a first length and a first bell mouth, a plurality of second swirler inlet cups passing through the cap and having a second length and a second bell mouth, and a third swirler inlet cup passing through the cap and having a third length and a third bell mouth, wherein the first length is different from the third length, and wherein the first bell mouth is different from the third bell mouth.

BRIEF DESCRIPTION OF THE DRAWINGS

FIG. 3(*b*) shows a side view of a combustor according to an embodiment of the subject invention.

DETAILED DISCLOSURE

Figure 1:
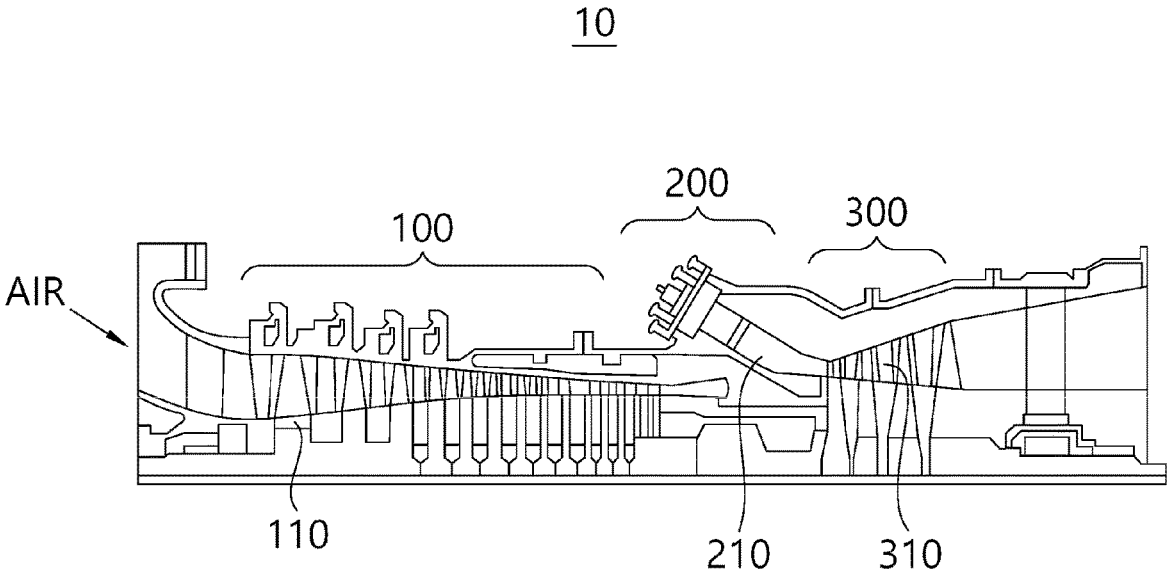
FIG. 1 shows a cross-sectional view of a gas turbine.

When the terms "on" or "over" are used herein, when referring to layers, regions, patterns, or structures, it is understood that the layer, region, pattern, or structure can be directly on another layer or structure, or intervening layers, regions, patterns, or structures may also be present. When the terms "under" or "below" are used herein, when referring to layers, regions, patterns, or structures, it is understood that the layer, region, pattern, or structure can be directly under the other layer or structure, or intervening layers, regions, patterns, or structures may also be present. The terms "includes" and "including" are equivalent to "comprises" and "comprising", respectively.

In addition, references to "first", "second", and the like (e.g., first and second portion), as used herein, and unless otherwise specifically stated, are intended to identify a particular feature of which there may be more than one. Such reference to "first" does not imply that there must be two or more. These references are not intended to confer any order in time, structural orientation, or sidedness (e.g., left or right) with respect to a particular feature, unless explicitly stated. In addition, the terms "first" and "second" can be selectively or exchangeably used for the members.

Furthermore, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated. That is, a dimension of each of the elements may be exaggerated for clarity of illustration, and the dimension of each of the elements may be different from an actual dimension of each of the elements. Not all elements illustrated in the drawings must be included and limited to the present disclosure, but the elements except essential features of the present disclosure may be added or deleted.

It is to be understood that the figures and descriptions of embodiments of the present invention have been simplified to illustrate elements that are relevant for a clear understanding of the invention, while eliminating (in certain cases), for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Figure 2:
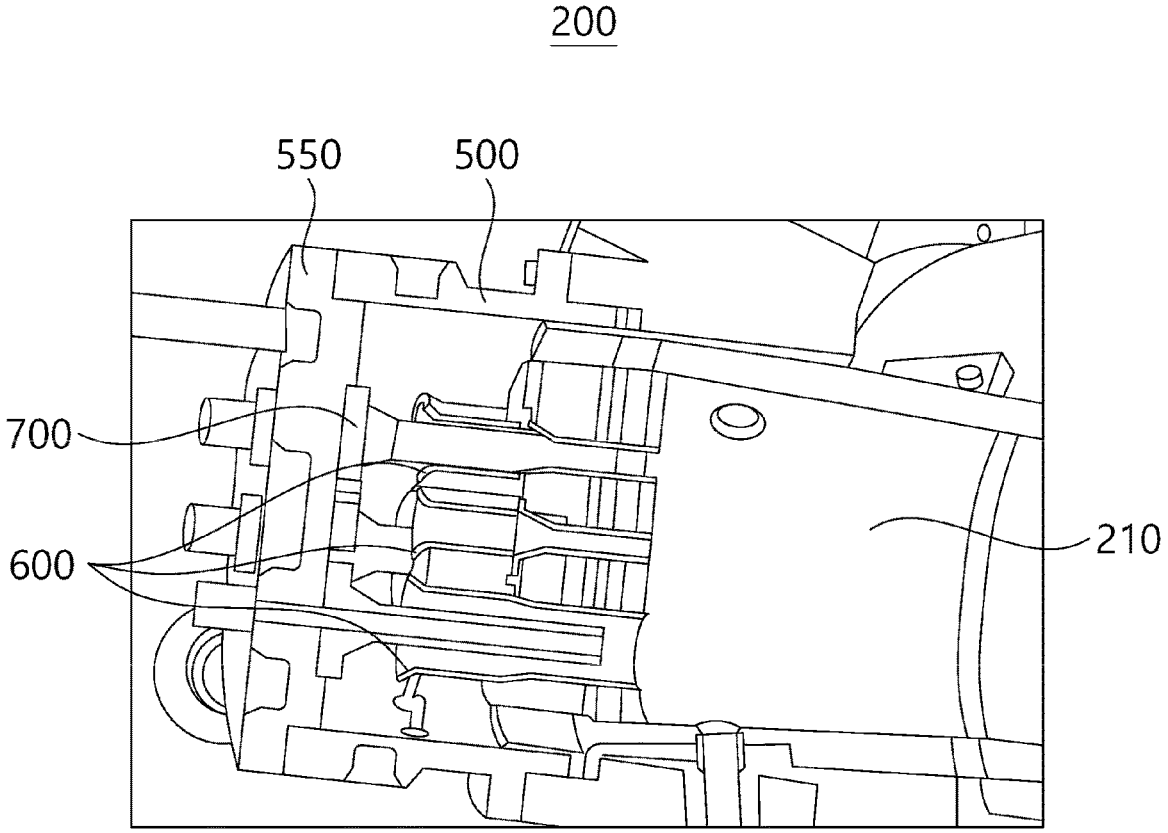
FIG. 2 shows a cross-sectional view of a combustor of a gas turbine.

Reference will be made to the attached figures on which the same reference numerals are used throughout to indicate the same or similar components. FIG. 1 shows a cross-sectional view of a gas turbine and FIG. 2 shows a cross-sectional view of a combustor of a gas turbine. Referring to FIGS. 1 and 2, a gas turbine 10 includes a compressor 100 having a compressor blade 110, a combustor 200 having a combustion chamber 210, and a turbine 300 having a turbine blade 310. Air is provided according to the arrow direction to the compressor blade 110 and compressed in the compressor 100, and then the compressed air is provided to the inside of a case 500 and a head end 550 of the combustor 200. The compressed air turns the flow direction around a plurality of swirler inlet cups 600 and then flows into the plurality of swirler inlet cups 600. The compressed air provided through the swirler inlet cups 600 is mixed and combusted with a fuel provided though a plurality of nozzles 700, thereby producing a hot gas in the combustion chamber 210. The hot gas generated in the combustion chamber 210 is supplied to the turbine blade 310 such that the turbine blade 310 turns.

Each of the plurality of swirler inlet cups 600 is placed in different position of the inside of the case 500 and the head end 550, thus the compressed air in each of the swirler inlet cups 600 has different air-flow. However, the plurality of swirler inlet cups 600 have the same length and the same bell mouth, thereby air-flow non-uniformity occurs. In particular, when the compressed air flows through the plurality of swirler inlet cups 600, the air-flow is separated and air pockets are formed in the swirler inlet cups 600, thereby resulting in the formation of worse air-fuel mixing quality and flame-holding event in the combustion chamber 210.

Figure 3A:
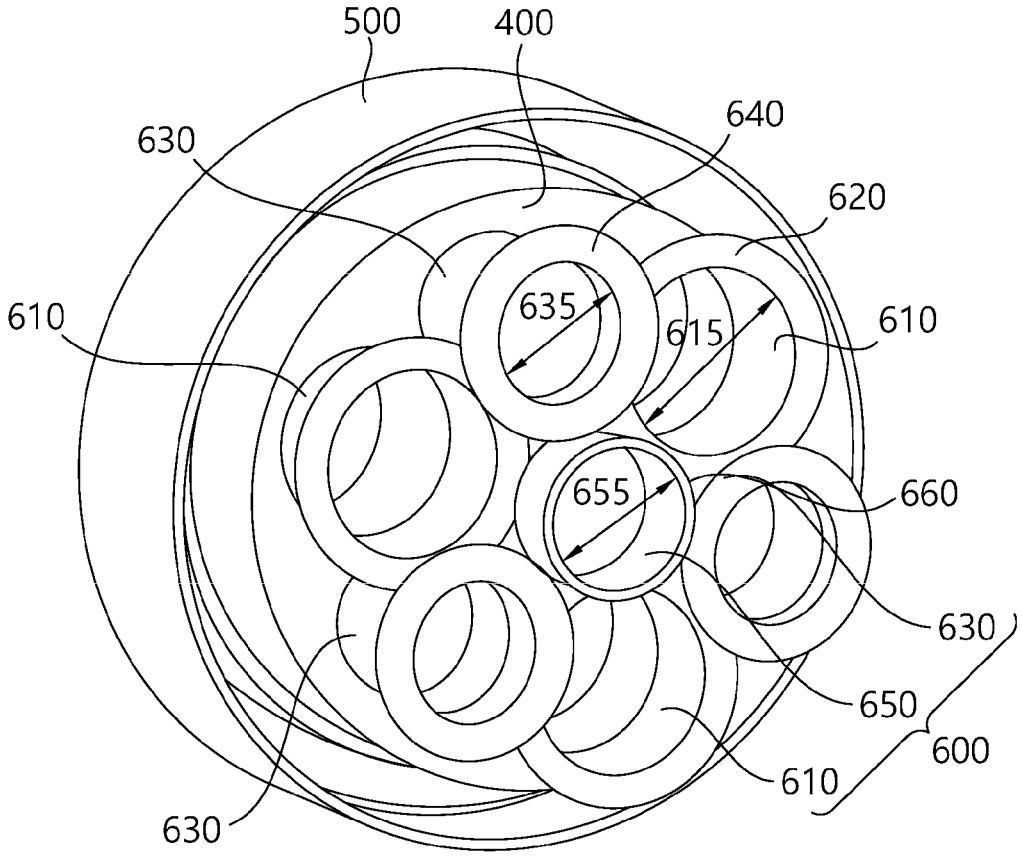
FIG. 3(*a*) shows a perspective view of a combustor according to an embodiment of the subject invention.
Figure 3B:
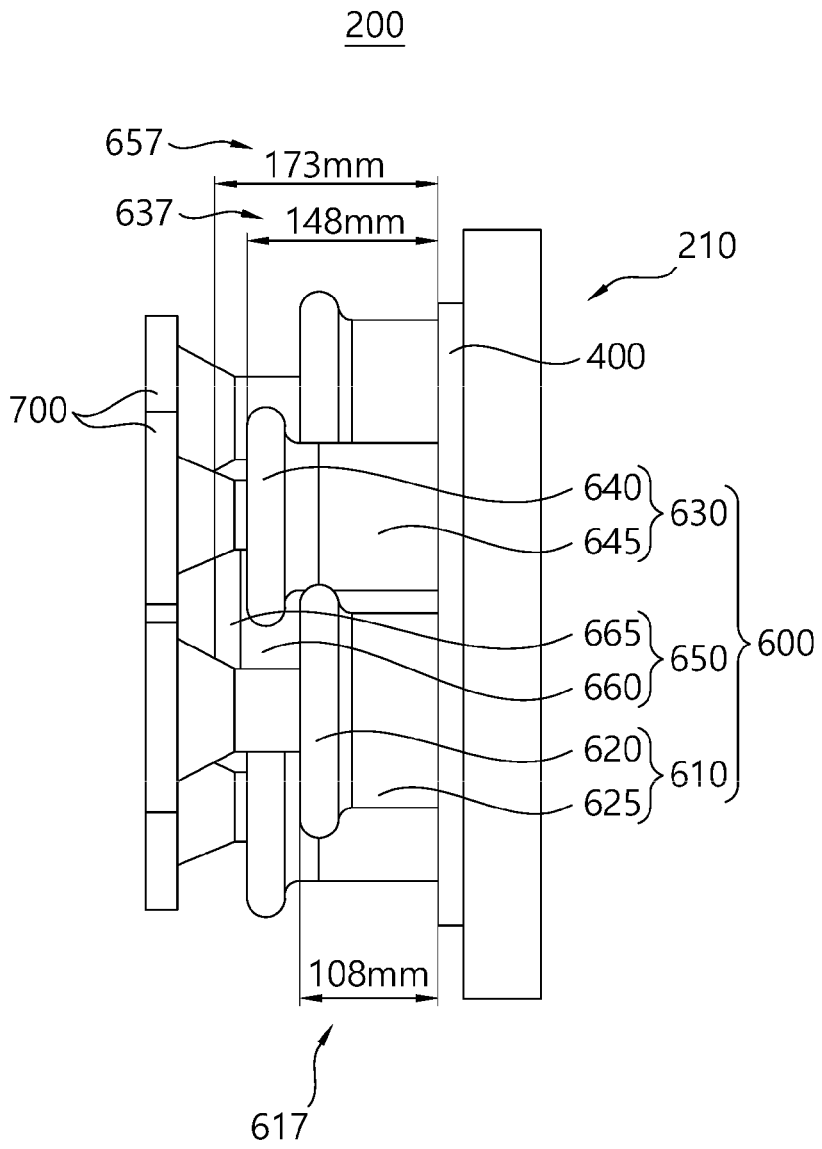

FIG. 3(*a*) shows a perspective view of a combustor according to an embodiment of the subject invention and FIG. 3(*b*) shows a side view of a combustor according to an embodiment of the subject invention. Referring to FIGS. 3(*a*) and 3(*b*), a combustor 200 includes a cap 400 covering a combustion chamber 210, a plurality of first swirler inlet cups 610 passing through the cap 400, a plurality of second swirler inlet cups 630 passing through the cap 400, a third swirler inlet cup 650 passing through the cap 400, and a case 500 surrounding the first to third swirler inlet cups.

The first swirler inlet cups 610 and the second swirler inlet cups 630 are placed in a peripheral region of the cap 400. Each of the first swirler inlet cups 610 includes a first tube 625 and a first bell mouth 620 disposed on a distal end of the first tube 625, wherein the first tube 625 has a first diameter 615 and a first length 617 of the first swirler inlet cups 610 is measured from a top surface of the cap 400 to the first bell mouth 620. Each of the second swirler inlet cups 630 includes a second tube 645 and a second bell mouth 640 formed on a distal end of the second tube 645, wherein the second tube 645 has a second diameter 635 and the second swirler inlet cups 630 have a second length 637 measured from the top surface of the cap 400 to the second bell mouth 640. When the first diameter 615 is larger than the second diameter 635, the first swirler inlet cups 610 are low swirler number (LSN) swirler inlet cups and the second swirler inlet cups 630 are high swirler number (HSN) swirler inlet cups. In this embodiment, the first length 617 of the first swirler inlet cups 610 is configured to be different from the second length 637 of the second swirler cups 630, thereby increasing air-flow uniformity in the first and second swirler inlet cups. In a particular embodiment, the first length 617 of the first swirler inlet cups 610 can be shorter than the second length 637 of the second swirler inlet cups 630.

The third swirler inlet cup 650 is placed in a center region of the cap 400. The third swirler inlet cup 650 includes a third tube 665 and a third bell mouth 660. In addition, the third swirler inlet cup 650 has a third diameter 655 of the third tube 665 and a third length 657 measured to the third bell mouth 660 from the cap 400. In this embodiment, the third length 657 is different from the first length 617 and the second length 637 in order to increase air-flow uniformity. In particular, the third length 657 is the longest, the first length 617 is the shortest, and the second length 637 is shorter than the third length 637 and longer than the first length 617. For example, the first length 617 is 108 mm, the second length 637 is 148 mm, and the third length 657 is 173 mm. However, alternative embodiments can have different numbers and the subject invention is not limited to lengths of a particular number or dimension. In addition, the third diameter 655 is smaller than the first diameter 615 and the second diameter 635. That is, the swirler inlet cups having a smaller diameter are designed to be longer than the swirler inlet cups having a larger diameter.

Referring to FIGS. 3(*a*) and 3(*b*), an inlet portion of each of the first 610, second 630, and third 650 swirler inlet cups has a toroidal element, such as the first 620, second 640, and third 660 bell mouths. In this embodiment, the third bell mouth 660 of the third swirler inlet cup 650 located in the center region is smaller than the first bell mouth 620 of the first swirler inlet cups 610 and the second bell mouth 640 of the second swirler inlet cups 630. In particular, a radius of the third bell mouth 660 is smaller than a radius of the first bell mouth 620 or a radius of the second bell mouth 640. For example, the first bell mouth 620 and the second bell mouth 640 have a radius of 15 mm, and the third bell mouth 660 has a radius of 5 mm. The third diameter 655 of the third swirler inlet cup 650 is smaller than the first diameter 615 of the first swirler inlet cups 610 and the second diameter 635 of the second swirler inlet cups 630, and thus the swirler inlet cups having a smaller diameter can be designed to have a smaller radius bell mouth for more uniform air-flow.

In this embodiment, the first swirler inlet cups 610 and the second swirler inlet cups 630 are arranged alternately in the peripheral region of the cap 400, where three first swirler inlet cups 610 and three second swirler inlet cups 630 are arranged to surround the third swirler inlet cup 650 placed in the center region of the cap 400. As the first length 617 of the first swirler inlet cups 610 is shorter than the second length 637 of the second swirler inlet cups 630, the first bell mouth 620 of the first swirler inlet cups 610 can be overlapped with the second bell mouth 640 of the second swirler inlet cups 630 when viewed from a top of the cap 400. In addition, the first bell mouth 620 can be in contact with the second tube 645 of the second swirler inlet cups 630 or the third tube 665 of the third swirler inlet cup 650 because in this embodiment, the first length 617 of the first swirler inlet cups 610 is different from the second length 637 of the second swirler inlet cups 630 and the third length 657 of the third swirler inlet cup 650.

The subject invention includes, but is not limited to, the following exemplified embodiments.

Embodiment 1

A combustion system, comprising:

a first swirler inlet cup having a first length, and a second swirler inlet cup having a second length, wherein the first length of the first swirler cup is different from the second length of the second swirler inlet cup.

Embodiment 2

The combustion system according to embodiment 1, further comprising a cap covering a combustion chamber, wherein the first and second swirler inlet cups pass through the cap.

Embodiment 3

The combustion system according to embodiment 2, wherein the first length and the second length are determined from a top surface of the cap.

Embodiment 4

The combustion system according to any of embodiments 2-3, wherein a first diameter of the first swirler inlet cup is larger than a second diameter of the second swirler inlet cup.

Embodiment 5

The combustion system according to embodiment 4, wherein the first length is shorter than the second length.

Embodiment 6

The combustion system according to embodiment 5, further comprising a third swirler inlet cup having a third length and passing through the cap, wherein the third length is different from at least one of the first length and the second length.

Embodiment 7

The combustion system according to embodiment 6, wherein a third diameter of the third swirler inlet cup is smaller than the second diameter of the second swirler inlet cup and the third length is longer than the second length.

Embodiment 8

The combustion system according to embodiment 7, wherein the third swirler inlet cup is placed in a center region of the cap, and the first swirler inlet cup and the second swirler inlet cup are placed in a peripheral region of the cap.

Embodiment 9

The combustion system according to embodiment 8, wherein a first radius of a bell mouth of the first swirler inlet cup is different from a third radius of a bell mouth of the third swirler inlet cup.

Embodiment 10

A combustion system, comprising:
a peripheral swirler inlet cup having a peripheral bell mouth; and
a center swirler inlet cup having a center bell mouth,
wherein the peripheral bell mouth and the center bell mouth are different from each other, and
wherein a length of the peripheral swirler inlet cup is different from a length of the center swirler inlet cup.

Embodiment 11

The combustion system according to embodiment 10, wherein a peripheral radius of the peripheral bell mouth is larger than a center radius of the center bell mouth.

Embodiment 12

The combustion system according to embodiment 11, further comprising a cap covering a combustion chamber, wherein the peripheral and center swirler inlet cups pass through the cap.

Embodiment 13

The combustion system according to embodiment 12, wherein the peripheral swirler inlet cup comprises a high swirler number (HSN) swirler inlet cup having a high bell mouth and a low swirler number (LSN) swirler inlet cup having a low bell mouth, and the center radius is different from at least one of a high radius of the high bell mouth and a low radius of the low bell mouth.

Embodiment 14

The combustion system according to embodiment 13, wherein the low radius is larger than the center radius and is the same as the high radius.

Embodiment 15

A gas turbine, comprising:
a combustion chamber receiving air from a compressor and producing a hot gas;
a cap covering the combustion chamber;
a first swirler inlet cup passing through the cap and having a first length and a first bell mouth;
a second swirler inlet cup passing through the cap and having a second length and a second bell mouth;
a third swirler inlet cup passing through the cap and having a third length and a third bell mouth; and
a turbine receiving the hot gas from the combustion chamber,
wherein the first length is different from the third length, and
wherein the first bell mouth is different from the third bell mouth.

Embodiment 16

The gas turbine according to embodiment 15, wherein the second length is different from at least one of the first length and the third length.

Embodiment 17

The gas turbine according to embodiment 16, wherein a third radius of the third bell mouth is smaller than a first radius of the first bell mouth.

Embodiment 18

The gas turbine according to embodiment 17, wherein the third swirler inlet cup is placed in a center region of the cap, and a plurality of the first and second swirler inlet cups are alternately positioned to surround the third swirler inlet cup at a peripheral region of the cap.

Embodiment 19

The gas turbine according to any of embodiments 17-18, wherein the first, second, and third swirler inlet cups have different diameters, respectively.

Embodiment 20

The gas turbine according to any of embodiments 17-19, wherein the air is provided to the combustion chamber through the first, second, and third swirler inlet cups.

Embodiment 21

A gas turbine, comprising:
a combustion chamber;

a cap covering the combustion chamber;

a plurality of swirler inlet cups passing through the cap;

a plurality of nozzles placed in the plurality of swirler inlet cups; and a case surrounding the plurality of swirler inlet cups and the plurality of nozzles, wherein the plurality of swirler inlet cups have different lengths and different bell mouths.

Embodiment 22

The gas turbine according to embodiment 21, wherein the plurality of swirler inlet cups comprises a first swirler inlet cup having a first length, a second swirler inlet cup having a second length, and a third swirler inlet cup having a third length.

Embodiment 23

The gas turbine according to embodiment 22, wherein the second length is shorter than the third length and longer than the first length.

Embodiment 24

The gas turbine according to embodiment 23, wherein the third swirler inlet cup is placed in a center region of the cap.

Embodiment 25

The gas turbine according to any of embodiments 22-24, wherein the first swirler inlet cup has a first bell mouth, the second swirler inlet cup has a second bell mouth, and the third swirler inlet cup has a third bell mouth.

Embodiment 26

The gas turbine according to embodiment 25, wherein a first radius of the first bell mouth is larger than a third radius of the third bell mouth.

Embodiment 27

The gas turbine according to embodiment 26, wherein a second radius of the second bell mouth is the same as the first radius of the first bell mouth.

Embodiment 28

The gas turbine according to any of embodiments 21-27, wherein air is provided to the combustion chamber through the plurality of swirler inlet cups.

Embodiment 29

The gas turbine according to any of embodiments 21-28, wherein a fuel is provided to the combustion chamber through the plurality of nozzles.

Embodiment 30

A combustion system, comprising:

a peripheral swirler inlet cup having a peripheral bell mouth and a peripheral diameter; and a center swirler inlet cup having a center bell mouth and a center diameter, wherein a peripheral radius of the peripheral bell mouth is different from a center radius of the center bell mouth.

Embodiment 31

The combustion system according to embodiment 30, wherein the peripheral diameter of the peripheral swirler inlet cup is larger than the center diameter of the center swirler inlet cup.

Embodiment 32

The combustion system according to any of embodiments 30-31, wherein the peripheral radius of the peripheral bell mouth is larger than the center radius of the center bell mouth.

Embodiment 33

The combustion system according to any of embodiments 30-32, further comprising a cap covering a combustion chamber, wherein the peripheral and center swirler inlet cups pass through the cap.

Embodiment 34

The combustion system according to any of embodiments 30-33, wherein the peripheral swirler inlet cup comprises a high swirler number (HSN) swirler inlet cup having a high bell mouth and a low swirler number (LSN) swirler inlet cup having a low bell mouth, and the center radius is different from at least one of a high radius of the high bell mouth and a low radius of the low bell mouth.

Embodiment 35

The combustion system according to embodiment 34, wherein the low radius is larger than the center radius and is the same as the high radius.

Embodiment 36

The combustion system according to any of embodiments 34-35, wherein a low diameter of the LSN swirler inlet cup is larger than a high diameter of the HSN swirler inlet cup.

Embodiment 37

The combustion system according to any of embodiments 30-36, further comprising a plurality of nozzles inserted into the peripheral and center swirler inlet cups.

Embodiment 38

The combustion system according to embodiment 37, wherein a fuel is provided through the plurality of nozzles such that the fuel is mixed with air provided through the peripheral and center swirler inlet cups.

A greater understanding of the present invention and of its many advantages may be had from the following example, given by way of illustration. The following example is illustrative of some of the methods, applications, embodiments, and variants of the present invention. It is, of course, not to be considered as limiting the invention. Numerous changes and modifications can be made with respect to the invention.

Example 1 Swirler Inlet Cups Having Different Length and Different Bell Mouth

A combustor can include: a combustion chamber, a cap covering the combustion chamber, a first swirler inlet cup passing through the cap and having a first length and a first bell mouth, a second swirler inlet cup passing through the cap and having a second length and a second bell mouth, and a third swirler inlet cup passing through the cap and having a third length and a third bell mouth, wherein the first length is different from the third length, and wherein the first bell mouth is different from the third bell mouth. A first radius of the first bell mouth and a second radius of the second bell mouth are 15 mm.

Figure 4:
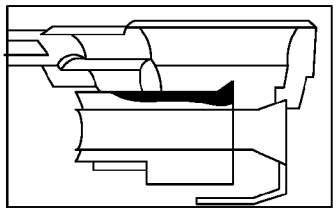
FIG. 4 shows simulation results according to an embodiment of the subject invention.
Figure 4:
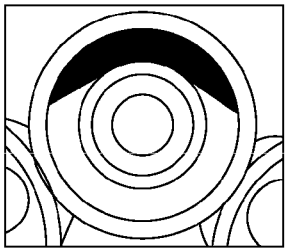
Figure 4:
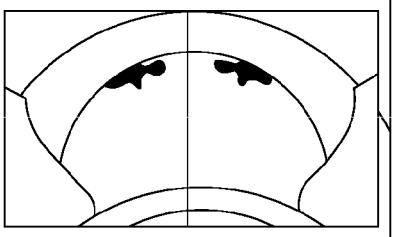
Figure 4:
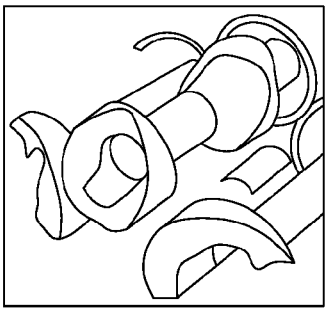
Figure 4:
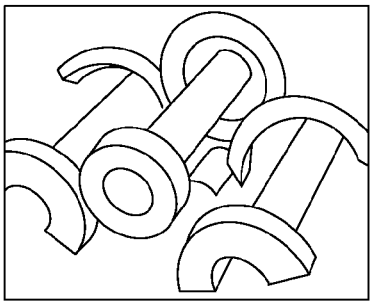

FIG. 4 shows simulation results according to an embodiment of the subject invention and compares the embodiment of the subject invention with the current design including swirler inlet cups having the same length and the same bell mouth. Referring to FIG. 4, an air pocket (green portion) is formed in the swirler inlet cups of the current design that have the same length and the same bell mouth. However, the HSN swirler inlet cup of the subject invention has no air pocket and the LSN swirler inlet cup of the subject invention has very small air pocket (green portion). The air pressure inside the HSN swirler inlet cup drops only by 0.5% with regard to the air pressure outside the HSN swirler inlet cup, thereby inhibiting an air pocket from being formed in the HSN swirler inlet cup.

Flow uniformity inside the HSN swirler inlet cup increases from 0.855 to 0.958 and flow uniformity inside the LSN swirler inlet cup increases from 0.857 to 0.954, wherein the flow uniformity is defined as a local flow speed ratio with respect to the average flow speed. Referring to the axial component profile of FIG. 4, while the flow speed of the current design is not uniform, the flow speed of the subject invention is ideally uniform.

It should be understood that the examples and embodiments described herein are for illustrative purposes only and that various modifications or changes in light thereof will be suggested to persons skilled in the art and are to be included within the spirit and purview of this application. Thus, the invention is not intended to limit the examples described herein, but is to be accorded the widest scope consistent with the principles and novel features disclosed herein.

What is claimed is:

1. A combustion system, comprising:

a cap that is configured to cover a combustion chamber and includes a center region and a peripheral region surrounding the center region;

a first swirler inlet cup that is arranged in the peripheral region and passes through the cap, the first swirler inlet cup having a first length and a first diameter;

a second swirler inlet cup that is arranged in the peripheral region and passes through the cap, the second swirler inlet cup having a second length longer than the first length and a second diameter smaller than the first diameter; and a third swirler inlet cup having a third length longer than the second length and passing through the cap, the third swirler inlet cup having a third diameter that is smaller than the second diameter.

2. The combustion system according to claim 1, wherein the first length and the second length are determined from a top surface of the cap.

3. The combustion system according to claim 1, wherein the third swirler inlet cup is disposed in the center region of the cap.

4. The combustion system according to claim 3, wherein a first radius of a bell mouth of the first swirler inlet cup is different from a third radius of a bell mouth of the third swirler inlet cup.

5. A combustion system, comprising:

a peripheral swirler inlet cup having a first length and including a peripheral bell mouth having a peripheral radius; and a center swirler inlet cup having a second length different from the first length and including a center bell mouth having a center radius smaller than the peripheral radius.

6. The combustion system according to claim 5, further comprising a cap covering a combustion chamber, wherein the peripheral and center swirler inlet cups pass through the cap.

7. The combustion system according to claim 5, wherein the peripheral swirler inlet cup comprises:

a high swirler number (HSN) swirler inlet cup including a high bell mouth having a high radius; and a low swirler number (LSN) swirler inlet cup including a low bell mouth having a low radius, and wherein the center radius is different from at least one of the high radius and the low radius.

8. The combustion system according to claim 7, wherein the low radius is larger than the center radius and is the same as the high radius.

9. A gas turbine, comprising:

a combustion chamber receiving an air from a compressor and producing a hot gas;

a turbine receiving the hot gas from the combustion chamber;

a cap covering the combustion chamber;

a first swirler inlet cup having a first length and passing through the cap, the first swirler inlet cup including a first bell mouth having a first radius;

a second swirler inlet cup having a second length and passing through the cap, the second swirler inlet cup including a second bell mouth having a second radius;

a third swirler inlet cup having a third length and passing through the cap, the third swirler inlet cup including a third bell mouth having a third radius different from the first radius, wherein the first, second, and third lengths are different from one another, and wherein the third swirler inlet cup is placed in a center region of the cap, and a plurality of the first and second swirler inlet cups are alternately positioned to surround the third swirler inlet cup at a peripheral region of the cap.

10. The gas turbine according to claim 9, wherein the third radius is smaller than the first radius.

11. The gas turbine according to claim 9, wherein the first, second, and third swirler inlet cups have different diameters, respectively.

12. The gas turbine according to claim 9, wherein the air is provided to the combustion chamber through the first, second, and third swirler inlet cups.

* * * * *